US006902199B2

(12) United States Patent
Colyer et al.

(10) Patent No.: US 6,902,199 B2
(45) Date of Patent: Jun. 7, 2005

(54) ROV ACTIVATED SUBSEA CONNECTOR

(75) Inventors: Angus N. Colyer, Quillan Aude (FR); Jon E. Hed, Houston, TX (US)

(73) Assignee: Offshore Systems Inc., Houston, TX (US)

( * ) Notice: Subject to any disclaimer, the term of this patent is extended or adjusted under 35 U.S.C. 154(b) by 0 days.

(21) Appl. No.: 10/440,076

(22) Filed: May 16, 2003

(65) Prior Publication Data

US 2004/0226722 A1 Nov. 18, 2004

(51) Int. Cl.[7] ..... F16L 35/00
(52) U.S. Cl. ..... 285/29; 285/920
(58) Field of Search ..... 285/118, 920, 285/322, 27, 28, 29; 29/705

(56) References Cited

U.S. PATENT DOCUMENTS 3,353,595 A * 11/1967 Gruller et al. ..... 166/341
3,717,920 A * 2/1973 Oliver et al. ..... 285/920
4,477,105 A * 10/1984 Wittman et al. ..... 285/920
4,664,419 A * 5/1987 Tan et al. ..... 285/920

OTHER PUBLICATIONS

U.S. Appl. No. 10/376,493, filed Feb. 28, 2003, Colyer.
U.S. Appl. No. 10/340,094, filed Jan. 10, 2003, Langford et al.
U.S. Appl. No. 10/358,731, filed Feb. 5, 2003, Langford et al.

* cited by examiner

*Primary Examiner*—Aaron Dunwoody
(74) *Attorney, Agent, or Firm*—Bracewell & Patterson, L.L.P.

(57) ABSTRACT

A subsea connector is remotely actuated to connect a subsea flowline to a subsea connector hub. The connector has a frame with a tubular mandrel located within it. The mandrel connects to the flowline and has a forward end that engages the connector end. The mandrel moves axially relative to the frame between retracted and extended positions. A lock member on the forward end of the mandrel will engage the profile of the connector hub. An actuator mounted to the mandrel causes the lock member to move into engagement with the connector hub after the mandrel has been moved into engagement with the connector hub. A portable telescoping jack assembly has an ROV interface for receiving power from the ROV. The jack assembly fits within a first pocket in the frame to move the mandrel to the extended position. The jack assembly is retrievable from the first pocket and fits within a second pocket in the frame to move the actuator and the lock member into locking engagement with the profile.

18 Claims, 7 Drawing Sheets

ROV ACTIVATED SUBSEA CONNECTOR

FIELD OF THE INVENTION

This invention relates in general to connecting subsea flowlines, and in particular to a connector that utilizes a portable jack assembly that is powered by an ROV (remote operated vehicle).

BACKGROUND OF THE INVENTION

Subsea installations often require the deployment of lines between one subsea piece of equipment and another. These lines, often called jumpers, may extend from a subsea well to a pipeline end termination, a manifold, or to a surface production flowline for production flow. Also, they may provide electrical power, electrical communications, optical communications, hydraulic power and chemicals to subsea trees, manifolds and distribution units. Typical lengths may vary from 20 meters to 4 kilometers. Normally such lines are installed from a reel located on a pipeline barge at the surface.

The ends of the flow jumpers must be connected remotely. A variety of different connectors has been developed. While workable, improvements are desired.

SUMMARY OF THE INVENTION

In this invention, an apparatus is utilized for remotely connecting a subsea flowline to a subsea connector. The apparatus has a connector frame. A tubular mandrel is carried by the frame with one end of the mandrel connected to a flowline and the other end for engagement with the connector hub. The mandrel is movable axially relative to the frame into engagement with the connector hub.

The frame has a first engagement point that is stationary relative to it. The mandrel has a second engagement point that moves with the mandrel and is axially spaced from the first engagement point. The frame has a pocket or opening between these engagement points.

A telescoping jack assembly is releasably inserted into the pocket. The jack assembly has opposite ends that engage the first and second engagement points. A power interface on the jack assembly causes the jack assembly to move the engagement points axially relative to each other to move the end of the mandrel into engagement with the connector hub. The power interface receives power from an ROV.

Preferably, the mandrel has a lock member on its end that is adapted to engage the profile of the connector hub. An actuator is slidably mounted to the mandrel for engaging the lock member. The frame has third and fourth engagement points, one being movable with the mandrel and the other being movable with the actuator. The jack assembly is retrievable from the first pocket and is repositioned into a second pocket between the third and fourth engagement points. An ROV supplies power to the jack assembly again to move the actuator and secure the lock member to the profile at the connector hub.

DETAILED DESCRIPTION OF THE INVENTION

Figure 1:
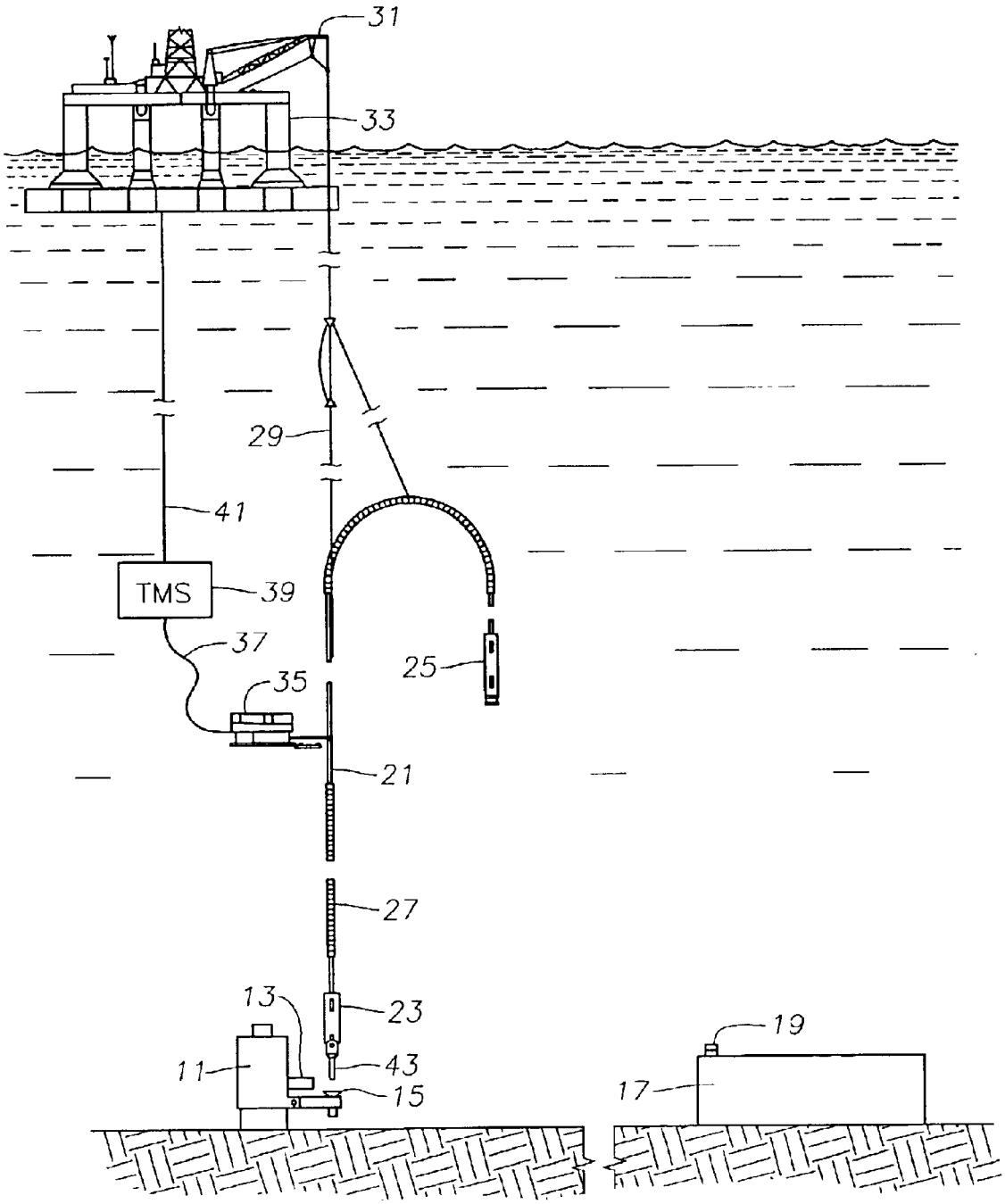
FIG. 1 is a schematic view of a flowline jumper having connectors in accordance with this invention, the flowline jumper being lowered into the sea for connecting a subsea wellhead with a manifold.

Referring to FIG. 1, a subsea wellhead 11 is shown schematically. Wellhead 11 is typically a subsea tree having a connector hub 13 extending horizontally from one side for the flow of production fluid. In this embodiment, a guide funnel 15 is mounted to and alongside wellhead 11. Guide funnel 15 faces upward and is located below and in alignment with connector hub 13.

A second piece of subsea equipment, shown to be a manifold 17, is spaced horizontally from wellhead 11 a distance that typically is in the range from 20 meters to 4 kilometers. Manifold 17 could be other types of subsea equipment, including other subsea wells. In this embodiment, manifold 17 is shown with a connector hub 19 that faces upward for receiving production flow from wellhead 11. Connector hub 19 could optionally face horizontally.

A flowline jumper 21 is shown being lowered into the sea for connecting connector hub 13 with connector hub 19. Flowline jumper 21 is preferably a section of steel pipe, which may be either continuous or formed of joints that are secured together. Flowline jumper 21 is shown to have flexibility in this embodiment, although having a flexible flowline is not required of this invention. Flowline jumper 21 has a first connector assembly 23 on one end for connecting to connector hub 13. Flowline jumper 21 has a second connector assembly 25 on the other end for connecting to manifold connector hub 19. In this example, flowline jumper 21 has buoyant sections 27 extending around it to add buoyancy. Flowline jumper 21 is shown being lowered into the sea on a lift line 29 deployed from a crane 31 located on a subsea drilling or production vessel 33.

An ROV (remote operated vehicle) 35 is shown assisting in guiding flowline jumper 21. ROV 35 is a conventional working class self-propelled vehicle capable of performing a variety of subsea tasks. ROV 35 is typically connected by a tether 37 to a tether management system 39. Tether management system 39 is suspended on an umbilical 41 that is lowered from vessel 33.

Figure 2:
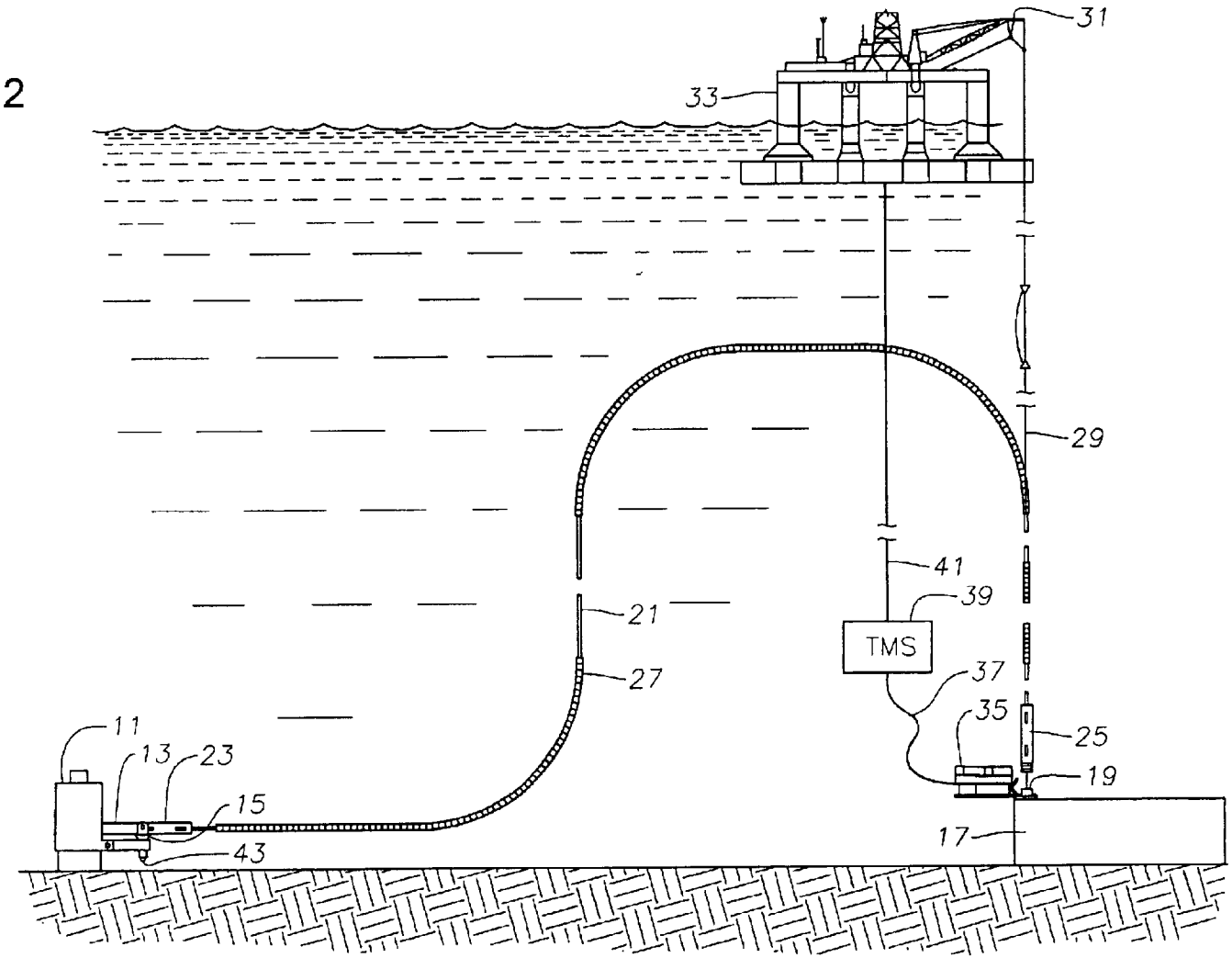
FIG. 2 is a schematic view of the flowline jumper of FIG. 1, showing one end connected to the subsea wellhead and the other end in the process of being connected to the manifold.

In the example shown, a stab 43 on the lower end of connector 23 is aligned with and stabs into guide funnel 15. Referring to FIG. 2, once stabbed into guide funnel 15, connector 23 hinges over to a horizontal position relative to stab 43 and into alignment with wellhead connector hub 13. FIG. 2 shows manifold connector 25 in vertical alignment with manifold connector hub 19 for connection thereto.

Buoyant members 27 cause a portion of flowline jumper 21 to elevate upward. The length of flowline jumper 21 is preferably greater than the actual distance from wellhead 11 to manifold 17.

Figure 3:
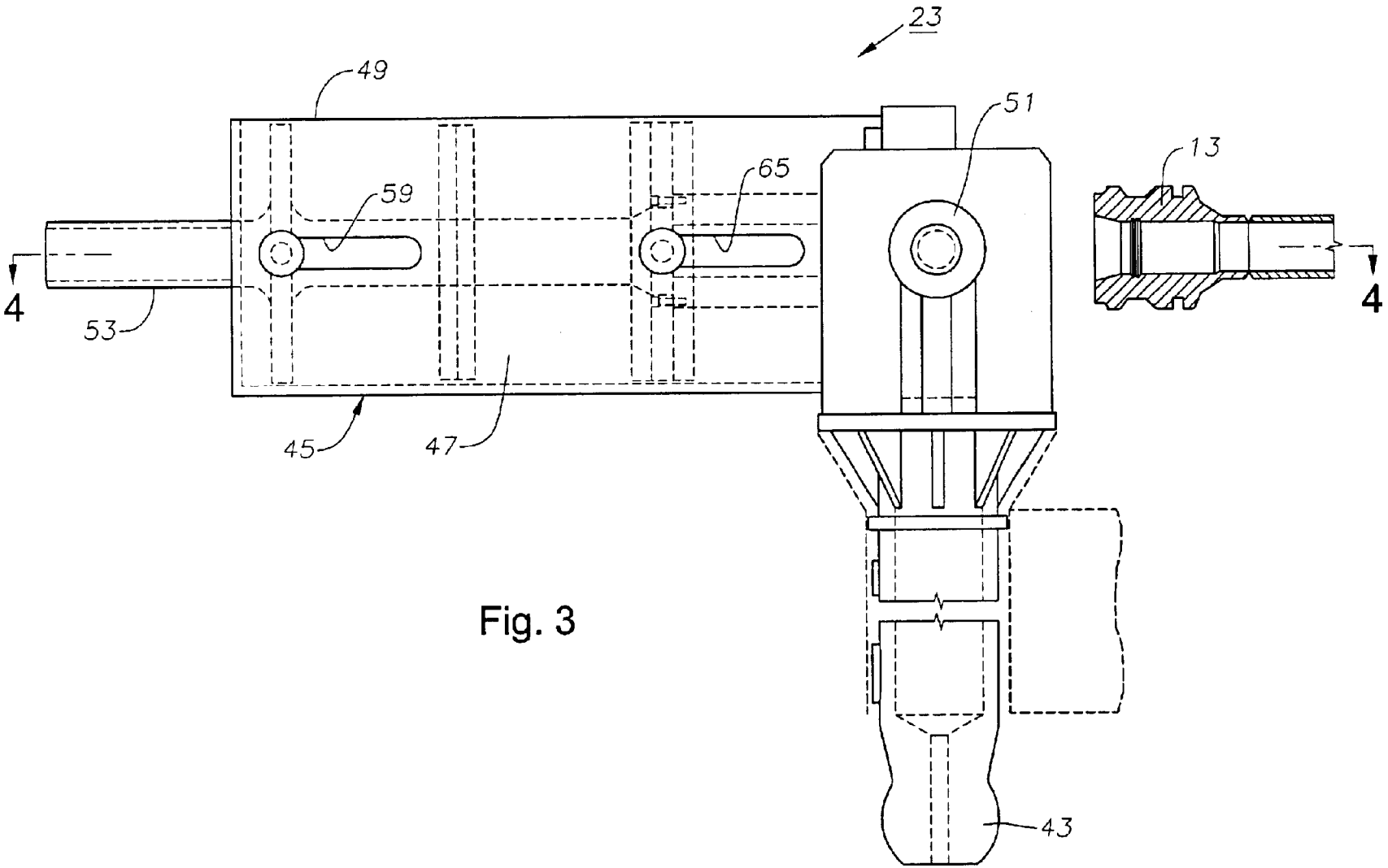
FIG. 3 is a side view of the connector of FIG. 1 that connects to the subsea wellhead.

Referring to FIG. 3, connector assembly 23 is shown in the folded-over position illustrated in FIG. 2. Connector assembly 23 has a frame 45 that is now located horizontally 90° relative to stab 43. Frame 45 has a bottom, two sidewalls 47 and an open top 49. Frame 45 may be generally rectangular or its sidewalls 47 and bottom may be cylindrical. Hinge 51 mounted to the forward end of frame 45 enables frame 45 to hinge over to the horizontal position relative to stab 43.

Figure 4:
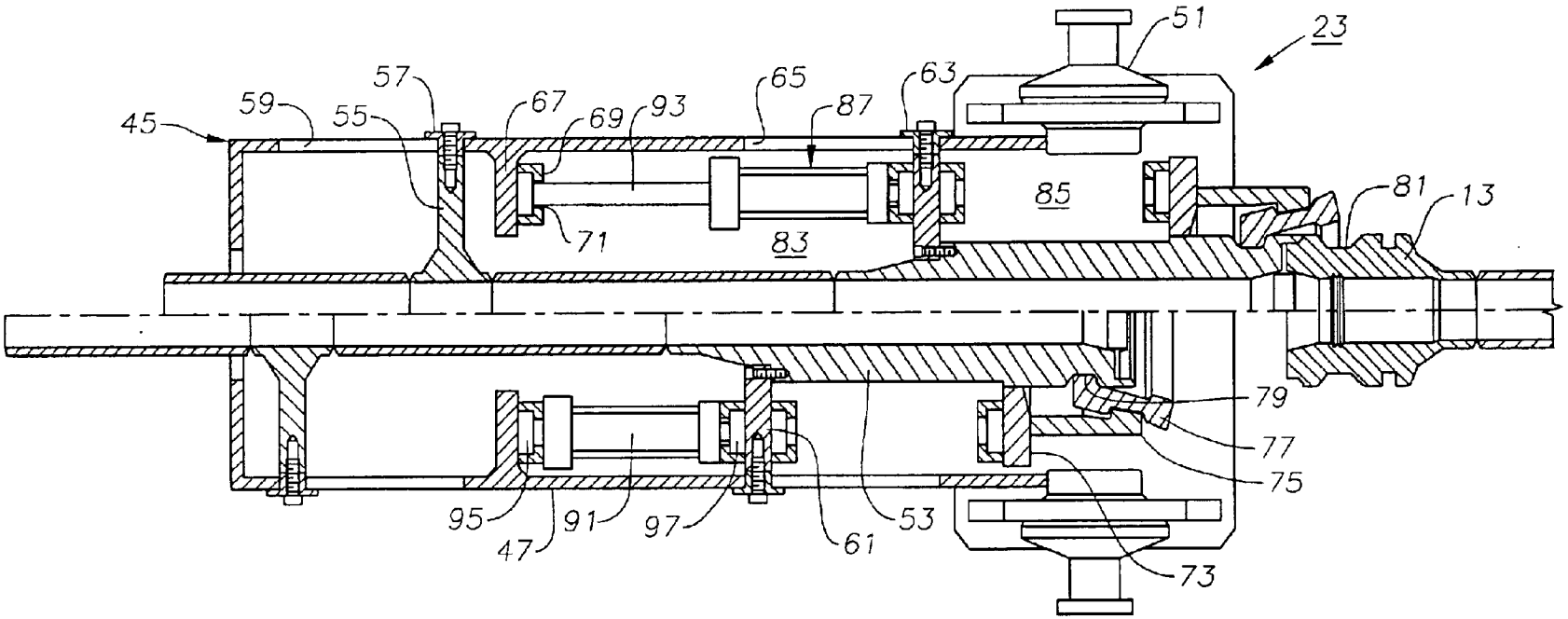
FIG. 4 is an enlarged sectional view of the connector of FIG. 3, taken along the line 4—4 of FIG. 3, and showing the upper half extended and the lower half retracted.

Referring to FIG. 4, which is an enlarged sectional view of FIG. 3, a connector mandrel 53 is mounted within frame 45. Connector mandrel 53 is a tubular member that has a rearward end that joins to flowline jumper 21 in a conventional manner. Connector mandrel 53 is movable axially relative to frame 45 as can be seen by comparing the upper half of the drawing of FIG. 4 with the lower half. The upper half of FIG. 4 shows mandrel 53 in an extended position protruding past the forward end of frame 45. The lower half of FIG. 4 shows mandrel 53 in a retracted position with its forward end recessed within the forward end of frame 45.

Connector mandrel 53 is carried within frame 45 by a rearward support 55. Rearward support 55 comprises laterally extending spokes or members that have rollers 57 on their outer ends. Rollers 57 roll on longitudinal slots 59 formed in sidewalls 47. The lower half of FIG. 4 shows roller 57 in a rearward position along slot 59, and the upper half shows roller 57 at the forward end of slot 59.

A forward support 61 supports mandrel 53 at a point axially forward from rearward support 55. Forward support 61 also comprises laterally extending spokes or members, each having a roller 63 on the outer end. Rollers 63 roll on slots 65 formed in sidewalls 47. Slots 65 are parallel to slots 59 and spaced forward from them. In the upper half of FIG. 4, roller 63 is shown at the forward end of slot 65, and the lower half shows roller 63 at the rearward end of slot 65. Each lateral member of forward support 61 has a rearward facing surface.

A pair of rearward shoulders or engagement points 67 are stationarily mounted to the interior of frame 45. Rearward shoulders 67 are located on opposite sides of mandrel 53 but do not contact mandrel 53. A retainer 69 is mounted to the forward face of each shoulder 67. Retainer 69 has a vertical slot 71 therein. A retainer 69 is also mounted to the rearward side of each member of forward support 61. Similarly, a retainer 69 is mounted to the forward side of each member of forward support 61.

An actuator 73 is carried on mandrel 53 near its forward end. Actuator 73 comprises a ring that surrounds an enlarged portion of mandrel 53. Actuator 73 includes a sleeve 75 that is secured to the ring portion of actuator 73 and extends forward. Actuator 73 has a pair of retainers 69 on its rearward facing side that are the same in this embodiment as retainers 69 on shoulders 67 and on forward support 61.

Figure 7:
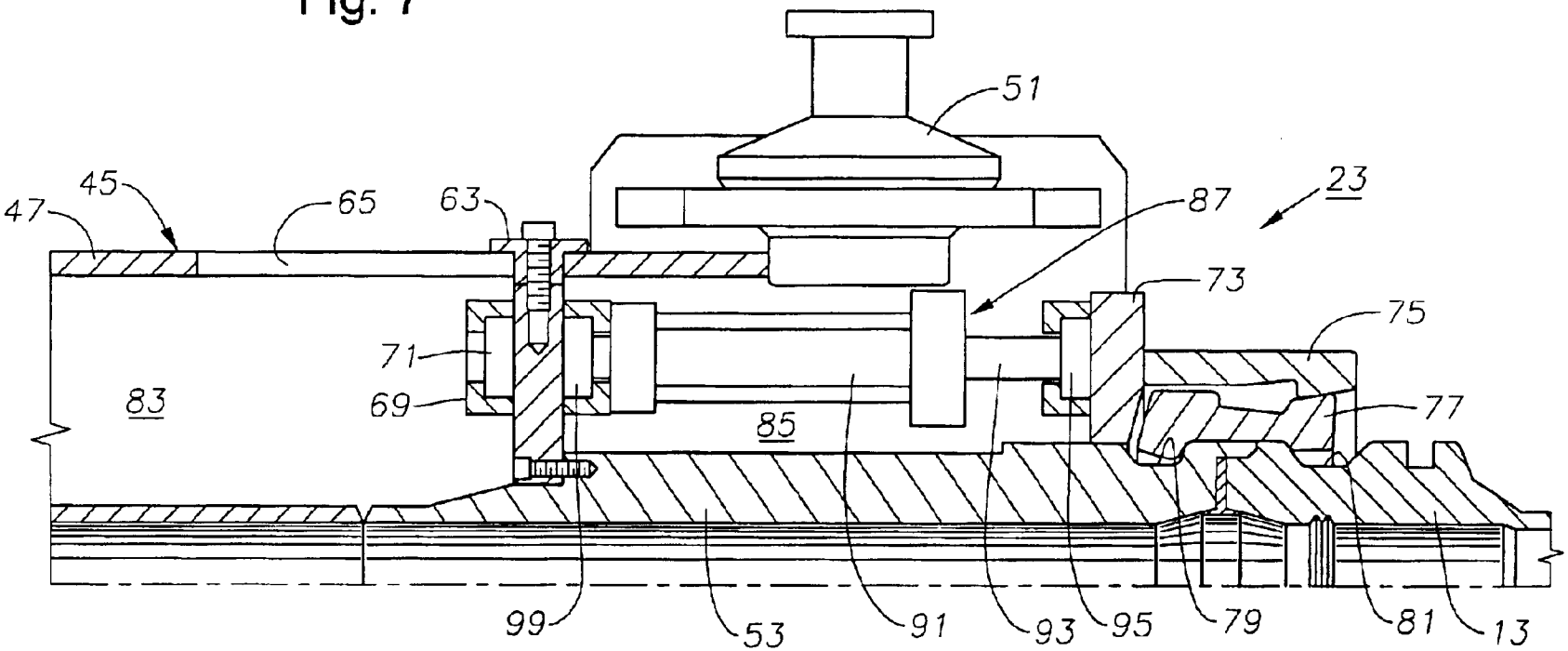
FIG. 7 is a further enlarged partial sectional view of the connector of FIGS. 3 and 4, with the jack assembly of FIGS. 5 and 6 shown connecting the lock member to the profile of the subsea wellhead connector hub.

A lock member 77 is also carried at the forward end of mandrel 53. As shown also in FIG. 7, in this embodiment, lock member 77 is an expansible collet that has a rearward enlarged end in engagement with a groove or profile 79 encircling mandrel 53. Collet 77 also has a forward end that is enlarged for engaging a connector hub profile 81. Connector hub profile 81 comprises an annular groove surrounding connector hub 13 near its rearward end. Lock member 77 has a natural position that is shown in FIG. 4 in which the forward end is at a greater diameter than the rearward end. Actuator sleeve 75 has an inner band that engages lock member 77 and pushes it inward when actuator 73 moves forward. The inward position, shown in FIG. 7, shows the forward end of lock member 77 locked into connector hub profile 81 and the rearward end of lock member 77 remaining in engagement with mandrel profile 79. FIG. 4 shows actuator sleeve 75 in a retracted position, with the hook bias of lock member 77 causing it to be pulled outward.

The space between rearward shoulder 67 and forward support 61 is open and accessible from open top 49, defining a first pocket 83. Similarly, the space between forward support 61 and the rearward side of actuator 73 is also open and accessible to open top 49 (FIG. 3), defining a second pocket 85.

A jack assembly 87 is schematically illustrated in first pocket 83. In the upper half of FIG. 4, jack assembly 87 is extended, while in the lower half, jack assembly 87 is retracted. Jack assembly 87 provides the necessary force to push mandrel 53 from the retracted position shown in the lower half of FIG. 4 to the extended position shown in the upper half of FIG. 4. Furthermore, the same jack assembly 87 locates within second pocket 85 for pushing actuator 73 from the retracted position shown in FIG. 4 to the extended position shown in FIG. 7.

Figure 5:
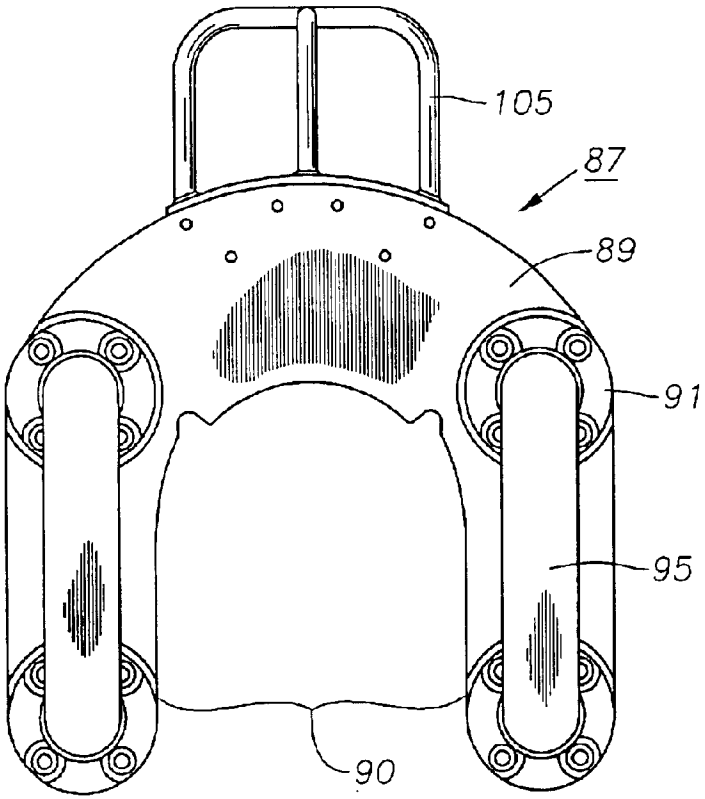
FIG. 5 is an end view of a jack assembly constructed in accordance with this invention for actuating the connector of FIGS. 3 and 4.

Referring to FIG. 5, jack assembly 87 is a portable unit having a frame member 89 on at least one end. Frame member 89 comprises a rigid plate that is in the shape of a horseshoe, defining a slot 90 between its legs for sliding over connector mandrel 53 (FIG. 4). In this embodiment, frame member 89 connects to four hydraulic cylinders 91, although this number can vary. Preferably, two hydraulic cylinders 91 are located on one side of slot 90 and two hydraulic cylinders 91 are located on the other side of slot 90, so that hydraulic cylinders 91 will be on opposite sides of connector mandrel 53 when installed as shown in FIG. 4.

Hydraulic cylinders 91 are parallel to each other, each having a piston rod 93 that extends parallel to the axis of mandrel 53 (FIG. 4) once installed. Piston rod 93 in this embodiment extends from only one end of each hydraulic cylinder 91. One retainer plate 95 connects two of the piston rods 93 together on one side of slot 90. Another retainer plate 95 connects the other two piston rods 93 on the other side of slot 90. Retainer plates 95 are elongated rectangular members positioned vertically and configured for sliding into the slots 71 of retainers 69 (FIG. 4). Preferably a stationary shaft 97 extends coaxially a short distance from the opposite end of each hydraulic cylinder 91. Each shaft 97 is fixed to one of the hydraulic cylinders 91 in this embodiment. Retainer plates 99, which are identical to retainer plates 95, connect two of the shafts 97 on each side of slot 90.

An ROV interface 101 is mounted to an upper portion of frame member 89. Interface 101 comprises a conventional connector for connecting to ROV 35 for supplying hydraulic fluid pressure to hydraulic cylinders 91. ROV interface 101 connects to each end of each hydraulic cylinder 91 for extending and retracting piston rods 93. Preferably hydraulic cylinders 91 are connected in parallel so that each piston rod 93 moves in unison with the others. Buoyant material 103 is bonded to frame member 89 and to hydraulic cylinders 91 for reducing the weight of jack assembly 87 in water. A handle 105 is secured to the upper portion of frame member 89 for engagement by ROV 35 to convey jack assembly 87.

Figure 6:
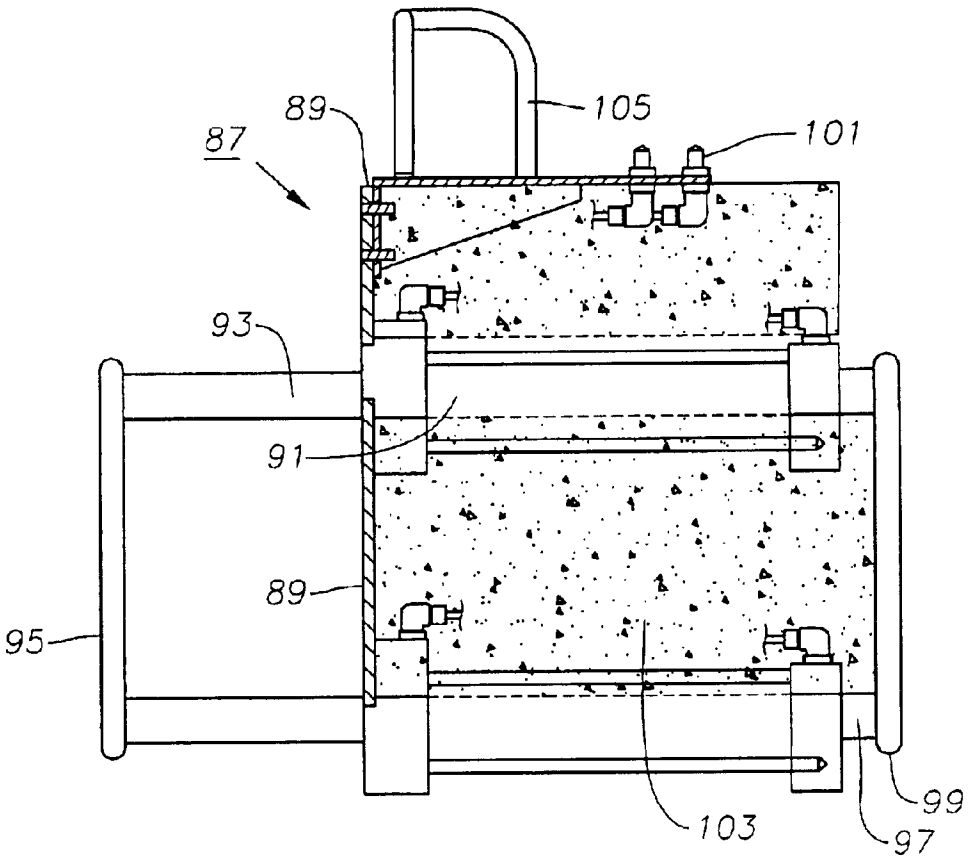
FIG. 6 is a side view of the jack assembly of FIG. 5.

In operation, after stab 43 lands in guide funnel 15, connector assembly 23 is folded over to the horizontal position shown in FIG. 2. Then ROV 35 will convey jack assembly 87 (FIG. 6) to connector 23. As shown in the lower half of FIG. 4, ROV 35 (FIG. 2) will slide jack assembly 87 into first pocket 83. Retainer plates 95 will slide into the retainers 69 attached to rearward shoulders 67, and retainer plates 99 slide into the retainers 69 on the rearward sides of forward support 61. Jack assembly 87 is retracted while this occurs. The position of jack assembly 87 could be reversed, if desired, so that retainer plates 95 engaged forward support 61 and retainer plates 99 engaged rearward shoulders 67.

ROV 35 (FIG. 2) engages interface 101 (FIG. 6) and supplies hydraulic fluid pressure to cause piston rods 93 to extend as illustrated in the upper half of FIG. 4. Piston rods 93 push mandrel 53 from the retracted position to the extended position with its end engaging or abutting the end of connector hub 13.

The operator on vessel 33 (FIG. 2) then signals ROV 35 to grasp handle 105 and pull jack assembly 87 from first pocket 83. Once removed, ROV 35 then causes hydraulic fluid pressure to flow to the opposite ends of hydraulic cylinders 91, causing piston rods 93 to retract. Once retracted, the operator slides jack assembly 87 into second pocket 85 as illustrated in FIG. 7. Retainer plates 95 are shown engaging retainers 69 of actuator 73 while retainer plates 99 are shown engaging retainers 69 on the forward side of forward support 61. The operator causes ROV 35 to supply hydraulic fluid pressure to extend piston rods 93, causing actuator sleeve 75 to push lock member 77 into engagement with profile 81 of hub connector 13. The amount of extension in pocket 85 is not as much as in pocket 83 in this example, although that could differ.

Figure 8:
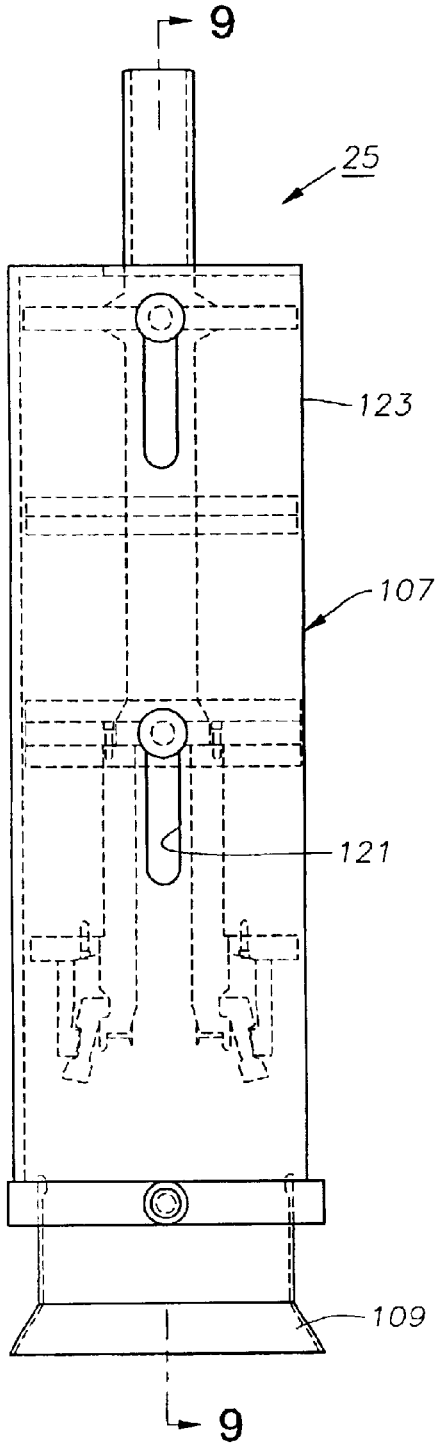
FIG. 8 is a side view of the manifold connector of FIG. 1.
Figure 9:
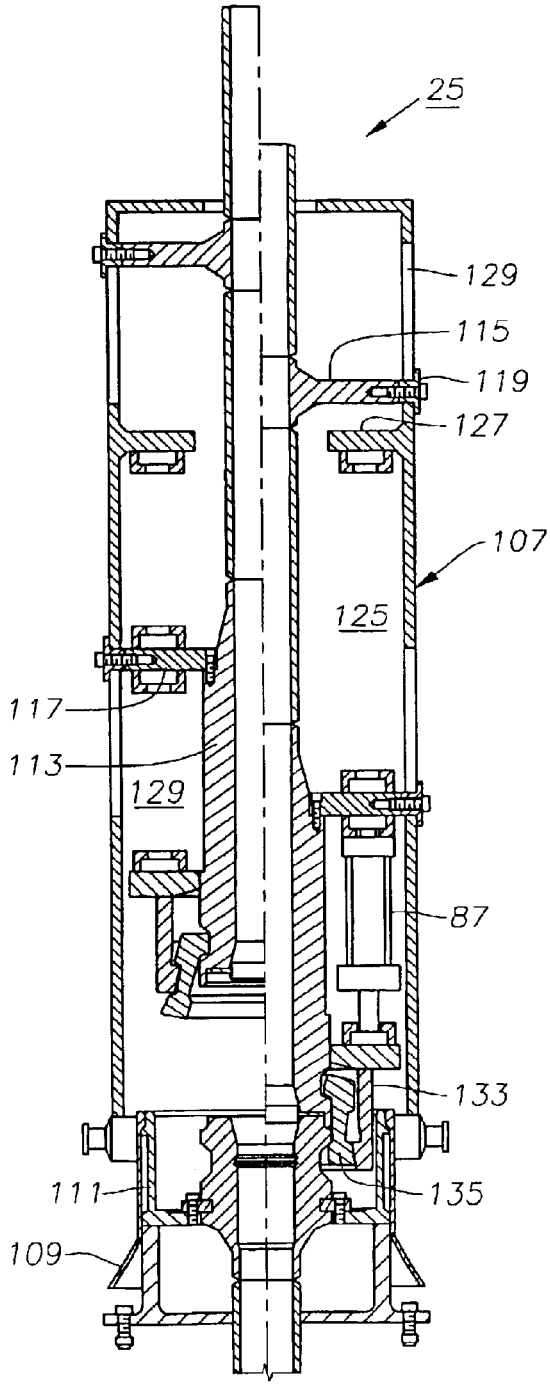
FIG. 9 is a sectional view of the connector of FIG. 8, taken along the lines 9—9 of FIG. 8, and showing the right half extended and the left half retracted.

The operator then withdraws jack assembly 87 from second pocket 85 and brings jack assembly 87 over for actuating second connector assembly 25 (FIG. 2). FIGS. 8 and 9 illustrate one embodiment of a second connector 25, which differs in that second connector 25 connects vertically, rather than horizontally. Consequently there is no need for a hinge similar to hinge 51 (FIG. 4). Otherwise, the components are generally the same and operate the same way. The second connector assembly 25 has a frame 107 that differs from the frame of the first embodiment in that it preferably has a funnel 109 stationarily mounted on its lower end. Funnel 109 engages a shroud 111 that surrounds manifold connector hub 19 in this embodiment. Shroud 111 has upward extending fingers that snap into releasable engagement with funnel 109.

Mandrel 113 is secured by supports 115, 117 to frame 107. Each support 115, 117 has a guide roller 119 that engages an axially extending slot 121. Frame 107 has an open side 123 in the same manner as open top 49 of frame 45 (FIG. 3). A first pocket 125 is located between a rearward or upper shoulder 127 in the interior of frame 107 and forward or lower support 117. A second pocket 129 is located between forward support 117 and an actuator sleeve 133. Actuator sleeve 133 engages a lock member 135.

The operation of the second connector assembly 25 is the same as the first connector assembly 23 except it does not hinge over. The same jack assembly 87 is first installed in first pocket 125 by ROV 35 (FIG. 1) to advance mandrel 113 forward or downward into engagement with connector hub 19. The right side of FIG. 9 shows mandrel 113 in the extended position, while the left side shows it in the retracted position. Then, ROV 35 removes jack assembly 87 from open side 123, retracts it and installs it in pocket 129. ROV 35 actuates jack assembly 87 to push actuator sleeve 133 downward, causing lock member 135 to lock to connector assembly 25. The operator then removes jack assembly 87 and retrieves it to vessel 33 (FIG. 1) if the subsea work has been completed. The same jack assembly 87 can be used for other making up other connections.

The invention has significant advantages. The connectors are remotely actuated with the assistance of an ROV. The connectors do not have hydraulic components, rather are mechanically actuated by a portable jack assembly. The same hydraulic jack assembly can be utilized for a vertical connector and a horizontal connector.

While the invention has been shown in only one of its forms, it should be apparent to those skilled in the art that it is not so limited but is susceptible to various changes without departing from the scope of the invention. For example, rather than hydraulic, the jack assembly could utilize a mechanical device such as threaded rods that are rotated by an ROV.

What is claimed is:

1. An apparatus for connecting a subsea flowline to a subsea connector hub, the connector hub having an end with a locking profile, comprising:

a connector frame;

a tubular mandrel carried by the frame and adapted to be connected to the flowline, the mandrel having an axis and an end that is adapted to engage the end of the connector hub, the mandrel being axially movable relative to the frame;

a first engagement point that is stationary relative to the frame and a second engagement point that is movable with the mandrel and spaced axially from the first engagement point, the frame having an opening between the engagement points;

a telescoping jack assembly that is releasably inserted into the opening, the jack assembly having opposite ends engaging the first and second engagement points;

an ROV interface on the jack assembly that is engageable with an ROV for causing the jack assembly to move the engagement points axially relative to each other to move the end of the mandrel into engagement with the end of the connector hub; wherein the jack assembly comprises:

a frame member;

at least two parallel hydraulic cylinders mounted to the frame member, the cylinders being spaced apart from each other for location on opposite sides of the mandrel when installed in the opening; wherein the ROV interface is in fluid communication with the hydraulic cylinders for receiving hydraulic fluid pressure from an ROV to stroke the cylinders; and a section of buoyant material is mounted to the frame member for lightening the weight of the jack assembly in water.

2. The apparatus according to claim 1, further comprising:

a lock member on the end of the mandrel that is adapted to engage the profile of the connector hub;

an actuator that engages the lock member and is slidably mounted to the mandrel;

a third engagement point that is movable with the mandrel and a fourth engagement point that is movable with the actuator and spaced axially from the third engagement point, the frame having an opening between the third and fourth engagement points; and the jack assembly being removable from the first mentioned opening and releasably inserted into the second mentioned opening for moving the third and fourth engagement points axially relative to each other to cause the actuator to secure the lock member to the profile on the connector hub.

3. The apparatus according to claim 1, wherein the jack assembly has a handling member on an upper side for engagement by the ROV to insert into the opening.

4. The apparatus according to claim 1, wherein the first engagement point is spaced axially farther from the end of the mandrel than the second engagement point.

5. The apparatus according to claim 1, wherein the first engagement point comprises:

a pair of first shoulders, each on an opposite side of the frame; and a first retainer on each of the shoulders facing toward the end of the mandrel for releasably retaining a first end of the jack assembly; and wherein the second engagement point comprises:

a pair of second shoulders, each on an opposite side of the mandrel; and a second retainer on each of the shoulders facing away from the end of the mandrel for releasably retaining a second end of the jack assembly.

6. The apparatus according to claim 1, further comprising:

a stab member mounted to the frame for stabbing into a receptacle adjacent the connector hub, the stab member being rotatable relative to the frame from a first position extending axially and a second position extending perpendicular to the axis of the mandrel.

7. An apparatus for connecting a subsea flowline to a subsea connector hub, the connector hub having an end with a locking profile, comprising:

a connector frame having a longitudinal axis and forward and rearward ends spaced axially apart;

a tubular mandrel located within the frame and adapted to be connected to the flowline, the mandrel having a forward end that is adapted to engage the end of the connector hub, the mandrel being axially movable relative to the frame between a retracted position, wherein the forward end of the mandrel is recessed within the frame, and an extended position wherein the forward end of the mandrel protrudes from the frame;

a lock member on the forward end of the mandrel that is adapted to engage the profile of the connector hub;

an actuator mounted to the mandrel for axial movement relative thereto and in engagement with the lock member; and a portable telescoping jack assembly having an ROV interface for receiving power from an ROV, the jack assembly fitting within a first pocket in the frame in engagement with the mandrel to move the mandrel to the extended position in contact with the connector hub, the jack assembly being retrievable from the first pocket and fitting within a second pocket in the frame in engagement with the actuator for moving the lock member into locking engagement with the profile.

8. The apparatus according to claim 7, wherein the first pocket is defined by a first engagement point that is stationary relative to the frame and a second engagement point that is movable with the mandrel and spaced axially forward from the first engagement point, the jack assembly having one end that engages the first engagement point and another end that engages the second engagement point while in the first pocket.

9. The apparatus according to claim 7 wherein the second pocket is defined by a third engagement point that is movable with the mandrel and located forward of the second engagement point; and a fourth engagement point engages the actuator for axial movement relative to the mandrel and is located forward of the third engagement point, one the end of the jack assembly engaging the third engagement point and the other end of the jack assembly engaging the fourth engagement point while in the second pocket.

10. The apparatus according to claim 7, wherein the jack assembly comprises:

a frame member;

at least two parallel hydraulic cylinders mounted to the frame member, the cylinders being spaced apart from each other for location on opposite sides of the mandrel when installed in the first pocket and in the second pocket.

11. The apparatus according to claim 10, wherein the jack assembly further comprises a section of buoyant material mounted to the frame member for lightening the weight of the jack assembly in water.

12. The apparatus according to claim 7, wherein the jack assembly has a handling member on an upper side for engagement by an ROV to insert and remove the jack assembly from the first and second pockets.

13. The apparatus according to claim 7, further comprising a plurality of retainers located at opposite ends of the first and second pockets, each of the retainers having a slot for slidingly receiving one of the ends of the jack assembly.

14. The apparatus according to claim 7, further comprising:

a stab member mounted to the frame for stabbing into a receptacle adjacent the connector hub, the stab member being rotatable relative to the frame from a first position extending axially and a second position extending perpendicular to the axis of the frame.

15. An apparatus for use in connecting a subsea flowline connector mandrel to a subsea connector hub, comprising:

a frame member;

at least two parallel hydraulic cylinders mounted to the frame member, the cylinders being spaced apart from each other for location on opposite sides of a connector mandrel;

a section of buoyant material mounted to the frame member for lightening the weight of the jack assembly in water;

a handling member on an upper side of the frame member for engagement by an ROV; and an ROV interface in fluid communication with the cylinders for receiving hydraulic fluid pressure from the ROV.

16. The apparatus according to claim 15, wherein the frame member has a closed upper end and an open slot between the hydraulic cylinders for insertion of the apparatus over a connection mandrel.

17. An apparatus for connecting a subsea flowline to a subsea connector hub, the connector hub having an end surrounded by a locking profile, comprising:

a connector frame;

a tubular mandrel located within the frame and adapted to be connected to the flowline, the mandrel having an axis and an end that is adapted to engage the end of the connector hub, the mandrel being movable axially relative to the frame;

a lock member on the end of the mandrel that is adapted to engage the profile of the connector hub;

a first engagement point that is stationary relative to the frame and a second engagement point that is movable with the mandrel and spaced axially from the first engagement point, the frame having an opening between the engagement points for receiving a portable jack assembly to move the engagement points axially relative to each other to move the end of the mandrel into engagement with the end of the connector hub; wherein:

the frame has a pair of axially extending slots, each located on an opposite side; and a plurality of supports extend laterally from the mandrel into sliding engagement with the slots.

18. The apparatus according to claim 17, further comprising:

an actuator that engages the lock member and is slidably mounted to the mandrel;

a third engagement point that is movable with the mandrel and a fourth engagement point that is movable with the actuator and spaced axially from the third engagement point, the frame having an opening between the third and fourth engagement points for receiving the jack assembly to move the third and fourth engagement paints axially relative to each other to cause the actuator to lock to the profile of the connector hub.

* * * * *